US005078274A

United States Patent [19]

Brown

[11] Patent Number: 5,078,274

[45] Date of Patent: Jan. 7, 1992

[54] METHOD AND APPARATUS FOR WOOD CHIP SIZING

[75] Inventor: Robert A. Brown, Wenatchee, Wash.

[73] Assignees: James River Corporation of Virginia, Richmond, Va.; Weyerhaeuser Company, Tacoma, Wash.

[21] Appl. No.: 479,458

[22] Filed: Feb. 13, 1990

[51] Int. Cl.[5] ..... B07B 9/00

[52] U.S. Cl. ..... 209/44.1; 162/55; 209/234; 209/629; 209/673

[58] Field of Search ..... 209/44.1, 2, 629, 632, 209/672, 673, 234, 235; 241/24, 28, 81, 68, 75; 162/55

[56] References Cited

U.S. PATENT DOCUMENTS

| | | | |
|---|---|---|---|
| 2,264,421 | 12/1941 | Ward | 209/2 X |
| 2,966,267 | 8/1958 | Dunbar | 209/271 |
| 3,337,139 | 1/1965 | Lloyd et al. | 241/20 |
| 3,819,050 | 6/1974 | Lower | 209/254 |
| 4,043,901 | 8/1977 | Gauld | 209/10 |
| 4,050,980 | 9/1977 | Schmidt et al. | 162/55 X |
| 4,167,438 | 9/1979 | Holz | 162/55 X |
| 4,234,416 | 11/1980 | Lower et al. | 209/247 |
| 4,351,719 | 9/1982 | Morey | 209/234 |
| 4,376,042 | 3/1983 | Brown | 209/38 |
| 4,430,210 | 2/1984 | Tuuha | 209/234 |
| 4,504,386 | 3/1985 | Dyren et al. | 209/254 |
| 4,802,591 | 2/1989 | Lower et al. | 209/680 |
| 4,903,845 | 2/1990 | Artiano | 209/671 |

FOREIGN PATENT DOCUMENTS

| | | | |
|---|---|---|---|
| 1252414 | 8/1986 | U.S.S.R. | 162/55 |

OTHER PUBLICATIONS

Hatton, "Screening of Pulpwood Chips for Quality of Profit", *Paper Trade Journal*, Apr. 30, 1979, pp. 25-27.

Smith et al., "The State of the Art in Chip Fines Screening", *Tappi Journal*, Sep. 1989, pp. 143-149.

"A New Concept in Overthick Chip Screening" by K. Kraft et al.

"An Albany Paper Mill Case Study—Chip Thickness Screening, Energy, and Production" by Dan J. Parker, Tappi Journal, Jan. 1983.

"Pulping Yields Increase with Chip Thickness Screening" by John Clark, Southern Pulp & Paper, Nov. 1983 (reprint).

"Chip Thickness Screening, Slicing System has Three--Month Payback" by Brian Briscoe, Pulp and Paper, Aug. 1985 (reprint).

"New-Concept 'V' Screen Improves Chip Quality at Fiskeby AB Mill" by James L. Keating, Pulp & Paper, Jun. 1980.

"Eurocan Improves Chip Quality with New Thickness Screening System" by Juan Villa, Pulp & Paper, Jul. 1983 (reprint).

"Chip Thickness Screening at Eurocan" by J. Vila, Pulp & Paper, 1985, pp. T306-T310.

"Chip Thickness Screening System Improves Medium Output, Quality" by James B. Porter, Pulp & Paper, Jun. 1981 (reprint).

"Weyco Begins Construction on Mississippi Pulp Mill" by Susan S. Taylor, American Papermaker, Jan. 1989.

"Chip Thickness Screening System is Key to Pulp Quality at Manville" by John Stimac et al., Pulp & Paper, Apr. 1987, pp. 124-127.

"Chip Screening Systems Remove Overthick and Fines Ahead of Digesters".

"Proper Selection of Chip Screening Systems" by Robert A. Brown, 1985, Pulping Conference, pp. 277-283.

"Keep Those Good Vibrations Happening at Your Mill", by Jackie Cox, American Papermaker, Feb. 1989, pp. 42-45.

"Advancing the State-of-the-Art in Screening Bark--Free and Non-Bark-Free Chips", by Elmer Christensen, Tappi, May 1976, vol. 59, No. 5, pp. 93-96.

*Primary Examiner*—Donald T. Hajec

*Attorney, Agent, or Firm*—Sixbey, Friedman, Leedom & Ferguson

[57] ABSTRACT

A system and process for sizing wood chips to provide a flow of wood chips which are acceptable for feeding to a digester of a pulping system. A flow management screen station is provided which divides an incoming unacceptable flow into two fractional flows, neither of which is acceptable for feeding to the digester. One of the output flows from the flow management screen is concentrated in oversized and overthick chips compared to the incoming flow. The other output flow is concentrated in undersized chips and particles compared to the incoming flow. The output flows from the flow management screen are then fed to second and third screening stations which separate "overs" from the respective flows to provide acceptable flows to the digester.

42 Claims, 4 Drawing Sheets

METHOD AND APPARATUS FOR WOOD CHIP SIZING

TECHNICAL FIELD

The invention relates to sizing of wood chips, and in particular to a screening system and process for sizing and dividing a flow of wood chips to provide a flow of chips which are acceptable for pulping.

BACKGROUND

In pulping of wood chips, it has been recognized that the thickness dimension of the wood chips plays an important role in the quality of the pulping process. During pulping, a digester receives chips and, through the use of chemicals, pressure and elevated temperatures, the wood is broken down into its constituents which include lignin and cellulose. The cellulose or wood fibers are then processed for making the pulp product. The thickness (or smallest dimension) of the chip is critical (as opposed to its length) since the thickness dimension determines the effectiveness of the alkaline digesting chemicals in penetrating to the center of the chip. As is recognized by those skilled in the art, in producing a uniform high yield pulp, providing a correctly sized and composed chip flow is extremely important.

Oversized and overthick chips are not properly broken down in the digester and can result in a reduced pulp yield due to the subsequent removal of these particles during the pulping process. Undersized chips typically include pins and fines, with pins comprising chips which are smaller than a desired chip size range, and fines even smaller particles such as sawdust or small bark particles. The undersized chips should also be removed from the chip flow which is fed to the digester, since undersized material can be overcooked in the digester resulting in a weakening of the overall pulp.

Thus, it is necessary to provide a flow of chips to the digester which is acceptable from a standpoint of having low levels of overthick chips and low levels of undersized chips. While complete removal of oversized and undersized chips is not necessary, and in fact is generally not practically or economically possible, the acceptable flow to the digester should contain overthick chips below a certain percentage and undersized chips below a certain percentage of the overall flow. The particular percentages which are deemed allowable in an acceptable flow (to the digester) can vary from pulping mill to pulping mill.

Chip screening systems are well-known. Many screening systems in use today are described in an article by E. Christensen appearing in the May 1976 TAPPI Journal, Vol. 59, No. 5. A gyratory screen is one type of screening device which provides high particle separation efficiency for given screen sizes. Gyratory screens have less of a tendency to upend and remove elongated particles such as pin chips, and there is less tendency to plug the screen openings with particles close to the screen opening size. Gyratory screens agitate the wood chips, causing the smaller particles to migrate downwardly toward the screen surface for removal. In addition, gyratory screens have less tendency to abrade and break chips into smaller pieces. Thus, gyratory screens effectively remove fines and retain pins, in separating the pins and fines from the wood chip flow.

Another typical screening device, as disclosed in the Christensen article is known as the disk screen. A disk screen includes a number of parallel rows of shafts upon which spaced rotating disks are mounted such that the disks on one shaft are axially spaced between the disks on an adjacent shaft. The spacing determines the size of chip that will fall through and those that stay atop and pass over disk screen. When the flow is large, and deep, a smaller proportion of the chips will have access to the spacing or slots between the disks. Thus, the flow rate (and the depth of the flow) also plays a role in determining the fraction of chips which pass through the screen. The rotation of the disks aids in orienting and to some extent urging the chips through the slots. Varying the rotational speed can therefore also affect the proportion of chips passing through the slots, though generally to a less extent than the spacing and flow rate. As described in the Christensen article, the disk screen will separate "overs", or in other words oversized and overthick chips, from the remainder of the flow, since the "overs" will generally not pass through the spacing between disks of adjacent shafts of the disk screen.

In one system described by Christensen, it is suggested to first pass an incoming chip flow over a disk screen to remove the "overs" fraction. The fraction which passes through the disk screen (i.e., between the disks of adjacent shafts) will contain the chips which are acceptably sized as well as pins, fines, sawdust, etc. The "overs" will be processed further to reduce their size to within a predetermined acceptable range of sizes. This system/method is the most commonly practiced today, and is known as a "Primary Thickness Control," since the primary thickness controlling unit is the first stage in the process.

Another chip sizing process is disclosed in U.S. Pat. No. 4,376,042 to Brown, in which an incoming flow of chips is divided into three fractions utilizing a gyratory screen. One fractional output flow includes an acceptable flow of chips. A second fraction includes acceptable chips as well as the oversized and overthick chips. The second fraction is directed to a disk screen which separates the overthick and oversized chips from the acceptable chips. The acceptable chips from the second fraction as well as the acceptable chips from the first fraction are then fed to the digester. The third fraction includes the undersized chips which are then removed from the system, and may be transported for example to a fuel bin.

The process described in the Brown patent was implemented in 1986 at the Weyerhauser Longview, Washington mill. The Weyerhauser process has proven successful in providing a "sustained high performance" chip thickness and chip uniformity system as well as providing a low maintenance operating system. The Brown/Weyerhauser process is viewed as a high performance chip thickness and uniformity system and currently ten systems utilizing this process are in use or under construction. While the relatively new Weyerhauser process is a significant advance in the industry it is important to note that systems which utilize a primary disk thickness screening process exceed 140 in the industry.

While the use of a disk screen as a primary thickness screen (in which oversized and overthick chips are separated from an incoming flow) has gained widespread acceptance it is constantly a goal to provide improved chip screening systems which can provide acceptable chip flows to digesters as economically as possible. Moreover, it is important that any such improvements be compatible with existing systems, such that existing systems may be retrofitted, thereby avoiding the tremendous capital outlay required for completely new systems.

SUMMARY AND OBJECTS OF THE INVENTION

It is therefore an object of the present invention to provide a screening system and screening process having improved efficiency and proficiency in providing an acceptable flow of wood chips to a pulping digester.

It is another object of the invention to provide a screening system/process in which a flow management screen separates an incoming flow into two fractional flows, neither of which is acceptable for feeding directly to the pulping digester, with both flows fed to subsequent screening stations which in turn provide acceptable flows to the digester.

It is yet another object of the invention to provide a screening system/process having a flow management screen which divides an incoming flow into two flows, one concentrated in undersized chips, pins and fines ("unders"); and the other concentrated in oversized and overthick chips ("overs"). The management of flow in this manner allows handling of the separate flows by screens particularly suitable for each flow, and allows for increased flow rates for the overall system.

It is a still further object of the present invention to provide a screening system/process which can handle increased flow rates, while the flow rate to the primary or main thickness screen (i.e., the screen which separates "overs") is reduced by utilizing a flow management screen which separates the incoming flow into two fractional flows. The reduced flow rate to the primary thickness screen allows the primary screen to more effectively separate overs from the flow and provide acceptably sized chips ("accepts") to the digester.

Yet another object of the present invention is to provide a screening system/process in which wear of the relatively expensive primary thickness screen is reduced, by substantial elimination of undersized chips, pins, fines, dirt and grit, from the flow directed to the primary thickness screen, while a flow containing a substantial majority of the pins and fines is directed to a relatively less expensive screen for removal of the "unders".

It is a further object of the present invention to provide an improved screening system/process, which is easily implemented in existing systems on a retrofit basis.

It is a further object of the present invention to place the brunt of the mechanical wear and maintenance costs on a flow management screen, thus protecting the more expensive main thickness screening unit. It is well-known that conventional horizontal disk screens are significantly less expensive and less costly to maintain than a standard V-screen (which is commonly utilized as the main or primary thickness screen in "Primary Thickness Control" systems), and therefore providing a horizontal disk screen upstream of the V-screen (thus reducing the load and wear on the V-screen) reduces the overall maintenance cost of the system. Moreover, since the flow management screen is operating under high flow rates, its performance is not as sensitive to wear, thereby allowing for more prolonged operation before maintenance is necessary.

These and other objects and advantages are achieved in which accordance with the present invention which applicant has developed to provide an improved system for screening wood chips which is more economical than existing systems, and which may be utilized with existing systems by the addition of a flow management screen or burden screen. The flow management screen may also be referred to as a burden screen since it relieves a portion of the flow burden from the primary or main thickness screen. In accordance with the present invention, the flow management screen or burden screen is provided upstream of the primary or main thickness screen, such that the incoming flow is divided into two fractional flows.

While the wood chips are initially directed to the flow management screen, the term "primary screen" or "main thickness screen" is retained herein to refer to the screen downstream of the flow management screen, since in retrofitting, it is the downstream screen (which separates the "overs" as discussed hereinafter) which, in present systems, acts as the primary thickness controlling unit. It is to be understood, however, that the objects and advantages attained by the present invention are equally applicable to new as well as existing systems. The flow management screen is provided with a much higher feed rate than is generally used with primary screens of existing systems, however since the flow management screen divides the flow, the flow provided to the primary screen is actually decreased, such that improved performance of the primary screen is obtainable. Reduction of the flow to the primary screen allows a tightening or reduction in the spacing between disks (I.F.O.) of the primary screen, which in turn can increase the overthick removal efficiency by 15–25%.

The flow management screen divides the incoming flow into first and second output flows, neither of which constitutes an acceptable flow, or in other words neither flow is suitable for direct feed to the digester. One of the flows from the flow management screen includes the oversized and overthick chips as well as chips which are acceptable or within a desired range of chip sizes. The second output flow of the flow management screen includes the undersized pins and fines, as well as acceptable chips. Thus, while neither of the output flows from the flow management screen are acceptable, handling of "overs" and "unders" may be dealt with separately by screening units downstream from the flow management screen which are more ideally suited for those particular tasks.

Significantly, the flow management screen provides one flow which is concentrated in "overs" and another which is concentrated in "unders". The flow having concentrated "unders" is then directed to a second screening station which separates the "unders" from the "accepts". The flow having concentrated "overs" is fed to a third screening station (which in retrofitting would be the existing primary thickness control unit) which separates the "overs" from the "accepts". The accepts from the second and third stations are then fed to the digester.

In a preferred embodiment, the flow management screen includes a horizontal disk screen, with the third screening station or primary screening unit including a V-disk screen and the second screening station including a gyratory screen. A significant advantage of the present invention resides in the fact that the flow directed to the second screening station is substantially free of pins fines, dirt and grit. The pins and fines, dirt and grit are known to abrade disk screens which can alter the interface opening or I.F.O. (the spacing between adjacent disks of the disk screen) and consequently diminish the effectiveness of the disk screen in separating the "overs" from the accepts. In addition, since the flow management screen divides the flow, the flow to the primary disk screen (second screening station) can be reduced, compared to flow rates generally utilized in existing systems, allowing a tightening or reduction of the I.F.O., such that the proficiency of the primary disk screen in separating the "overs" is increased, while the overall system flow is also increased.

In accordance with the present invention, the life of the primary disk screen can be prolonged by a factor of 1.5–3 times. While the flow management screen does handle the pins and fines, since it is an initial (flow management) screen, the I.F.O. is not as critical, and thus any abrasion due to the pins and fines is not as degrading to the overall system integrity. In addition, utilizing a horizontal disk screen for the flow management screen (which is much easier and less costly to maintain than V-screens which are typically used as the primary thickness screen), further reduces the overall maintenance costs. As shown in FIG. 1, the flow of wood chips is transverse to the roll axes of the horizontal disk screen, but substantially parallel to the roll axes of the V-screen. In both screens, wear occurs more heavily at the upstream side of the screen. With the V-screen, this wear results in an unacceptably worn portion at the upstream side of the rolls, requiring replacement of entire rolls (even though only a third of the roll may be worn). In contrast, with the horizontal screen, the front roll will wear first, and the wear will be more evenly distributed across the roll. Thus, with the horizontal screen, fewer rolls require replacement, and the replaced rolls do not have large wasted, unworn portions.

Disk screens are significantly more expensive than gyratory screens. Typical disk screens presently cost on the order of $2000/ft.$^2$ while gyratories are $350/ft.$^2$. However, disk screens are significantly more effective in separating overs from accepts, due to their ability to "find" the minimum dimension or thickness of the chips. This ability results from rotary disks aiding the minimum chip dimension in finding the slots between adjacent disks. Primary disk screens operating under typical load levels in existing systems wear rapidly, thus decreasing its effectiveness in separating overs. An increase in the I.F.O. or the standard deviation of the I.F.O. is an indication of such wear. Often disk screens require replacement or repair within one year of use. The present invention decreases wear to the main or primary disk screen by removing unders from the flow to the primary, and decreasing the flow rate to the primary screen. Thus, the advantages of the disk screen are utilized in separating overs, while its life is prolonged.

Other objects and advantages of the present invention will become apparent from the following detailed description read in conjunction with the drawings.

DETAILED DESCRIPTION OF THE PREFERRED EMBODIMENT

Figure 1:
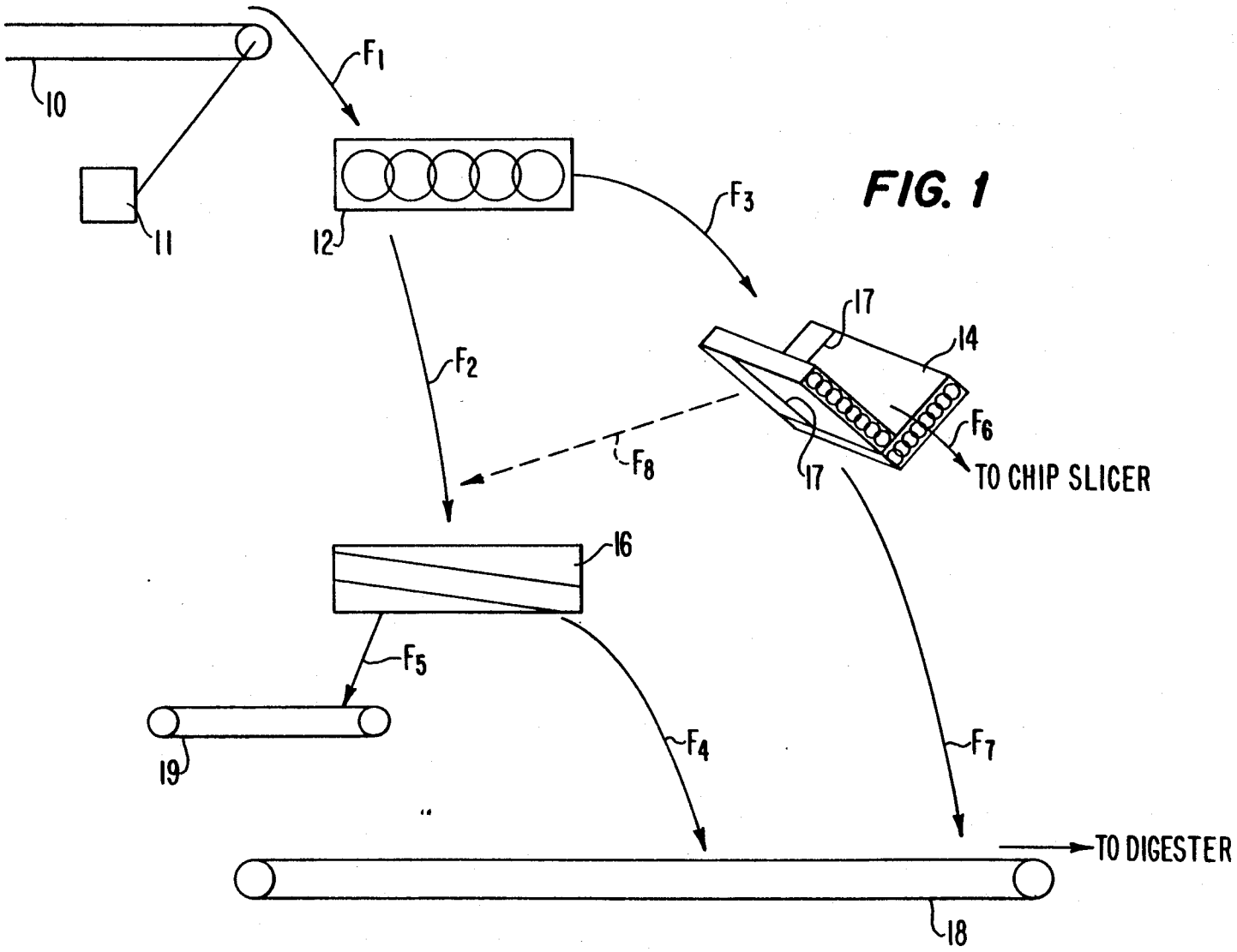
FIG. 1 schematically illustrates the chip screening system/process in accordance with the present invention.

As shown in FIG. 1, in accordance with the present invention, an incoming flow is provided for example by a conveyer 10, with the flow $F_1$ fed to a flow management screen or burden screen 12. A suitable control 11 is provided to control the flow rate of flow $F_1$. The flow management screen divides the flow into two fractional flows $F_2$ and $F_3$, neither of which is acceptable for direct feeding to the digester. What constitutes an "acceptable" flow may vary from pulping mill to pulping mill, however generally an acceptable flow will contain below a prescribed limit of "overs" (for example 3–5%) and below a prescribed limit of "unders" (for example 1–2%).

While neither flow $F_2$ nor $F_3$ constitute acceptable flows, the flow management screen 12 does function to separate the unacceptable components such that $F_3$ is acceptable from an "unders" standpoint and flow $F_2$ is acceptable from an "overs" standpoint. In other words, flow $F_3$ includes both accepts and the predominant portion of the "overs" from $F_1$, while $F_2$ contains accepts and a predominant portion of the "unders" from $F_1$. Thus, the flow management screen 12 serves to concentrate the "overs" in flow $F_3$ and concentrate the "unders" in flow $F_2$. It is to be understood that, while flow $F_2$ is designated as primarily comprising unders and accepts, a very small percentage of overs may also pass through the flow management screen into the flow $F_2$. Likewise, while flow $F_3$ is designated as generally containing "overs" and accepts, a small portion of "unders" will also be present, as pins and fines will travel along with the accepts and overs in passing over the disk screen 12. A small amount of unders may remain in the flow $F_3$ due to particles or pins sticking to larger chips, or a flow surge preventing access of some of the unders to the slots of the flow management screen.

The flow $F_3$ is then directed to a primary thickness screen, which may be a V-disk screen as in the embodiment illustrated in FIG. 1. The V-disk screen separates the overs from the accepts. The flow $F_6$ of overs is then directed to a chip slicer which further processes the oversized and overthick chips to acceptable sizes. The flow $F_7$ constitutes an acceptable flow for feeding (for example by a conveyer 18) to the digester of the pulping system. The acceptable flow would generally not be totally free of unders and overs, but the percentage or proportion of unders and overs are each below predetermined levels so that the flow is satisfactory. If desired, a lower portion of the flow (including accepts and unders) through the V-screen can be pealed away by known means (shown schematically at 17, FIG. 1) and sent to the gyratory screen as indicated by flow $F_8$ for removal of the unders.

The flow $F_2$ containing unders and accepts is fed to a gyratory screen which separates the flow into a flow of unders $F_5$ and a flow of accepts $F_4$. The accepts $F_4$ are fed to the digester such that the acceptable flow resulting from the incoming flow $F_1$ includes the flow $F_7$ from the V-disk screen 14 and the flow $F_4$ from the gyratory screen 16. The unders flow $F_6$ are then removed by a suitable conveyer 19 and may be transported, for example, to a fuel bin. While the gyratory screen is illustrated as having two outputs, gyratory screens may have more than two outputs if desired. For example, the gyratory screen may have two unders outputs, one of pins, the other of fines. The gyratory screen may also have an overs output, however since the flow $F_2$ is acceptable from an overs standpoint, this would not generally be necessary. Thus, while two outputs are shown, three or four outputs are also possible in accordance with the present invention.

While particular types of screens are illustrated in the FIG. 1 embodiment, the present invention should not be construed as limited to the illustrated screen types, as other types of screens are contemplated within the scope of the present invention. For example, the flow management screen 12 may take the form of a diamond roll screen or a spiral roll screen. While it is conceivable that a gyratory screen could be used as a flow management screen, generally a gyratory screen would not be acceptable due to the vibrations and space requirements associated with gyratory screens, especially in retrofit situations. Gyratory screens have been known to create vibrations to the extent that if mounted in the upper portion of a screening system, the integrity of the entire screening system, the structure supporting the screening system or other components of the screening system would be jeopardized. See e.g., "Keep Those Good Vibrations Happening At Your Mill", in the February, 1989 issue of American Papermaker.

Similarly, while a V-disk screen is illustrated as the primary thickness screen 14, a horizontal disk screen or spiral roll screen may also be utilized. The disk-type screens are generally more expensive than the gyratory screens, however they are more effective in separating "overs" from accepts with precision. Disk-type screens (both horizontal and V) are more susceptible to abrasion resulting from a large quantity of pins and fines. Thus, the less expensive gyratory screen is particularly suitable for separating the pins and fines from the accepts in the screening station illustrated at 16. It is also to be understood that while flow $F_1$ is designated as the incoming flow, generally a gross scalper is provided upstream of the flow management screen 12 as would be understood by those skilled in the art. The gross scalper is utilized for separating extremely large wood portions and other debris, on the order of 80 mm in size.

Figure 2A:
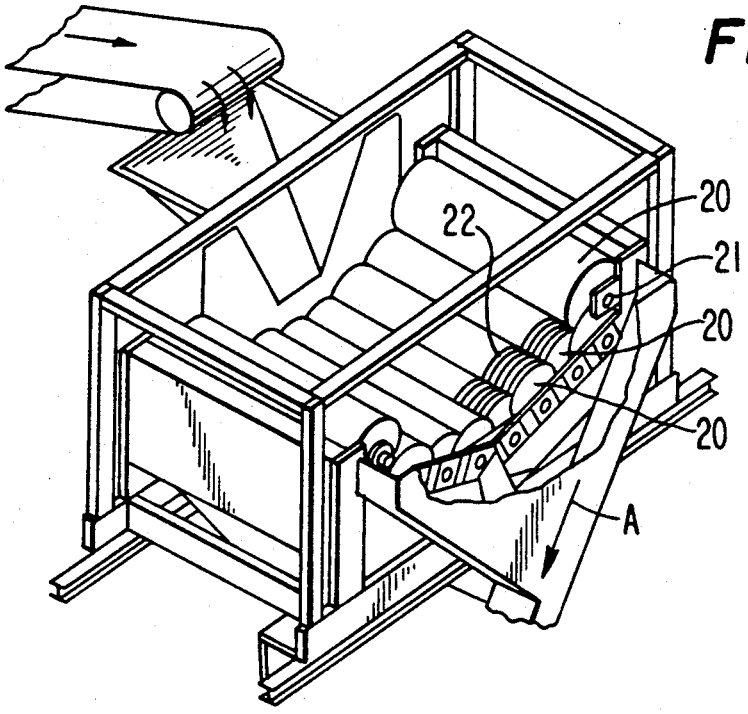
FIGS. 2A and 2B illustrate a conventional V-disk screen which may form a component of the screening system of the present invention.
Figure 2B:
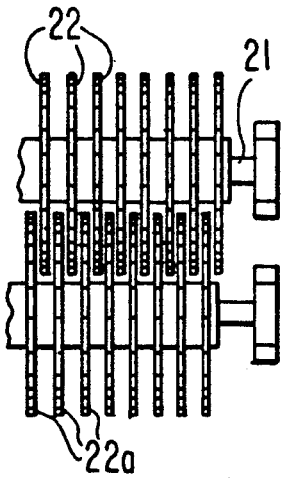

For improved clarity, brief reference is made to the drawings of FIGS. 2A,2B, 3 and 4 which illustrate disk, diamond roll and spiral roll screens. As shown in FIGS. 2A and 2B, a V-disk screen includes a plurality of rotating rolls 20, each mounted upon shafts 21 with the rolls at the center of the screen forming the lowest point, such that the rolls are arranged in a generally V-shaped pattern. As shown particularly in FIG. 2B, each roll includes a plurality of disks 22 which intermesh with disks **22*a* of an adjacent roll. The spacing between disks of adjacent rolls 22,22*a* is referred to as the interface opening (I.F.O.). The I.F.O. and the flow rate per unit area of the screen can be varied to vary the degree of chip separation, thus changing the characteristics of the throughflow (the flow which passes through the rolls or between the disks) and the overflow (the flow passing over the rolls and out of the screen without passing through the bottom of the screen, as indicated by arrow A in FIG. 2A**). A horizontal disk screen is similar to the V-disk screen, however the rolls are arranged such that their shafts lie generally in a common plane. While the flat screen is called "horizontal" since the rolls are in the same plane, the horizontal screen may be tilted or inclined, if desired.

Figure 3:
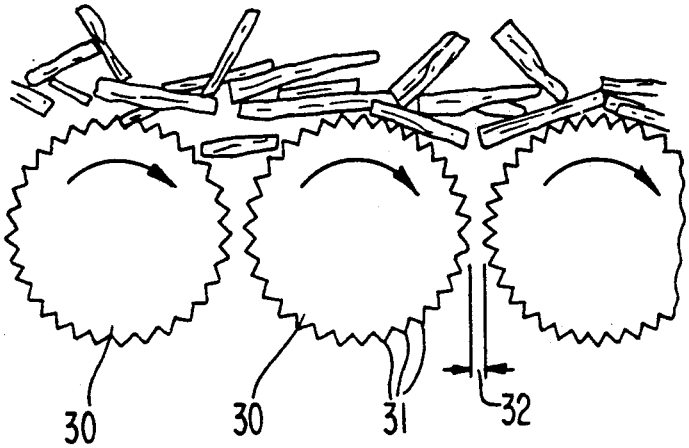
FIG. 3 illustrates a partial side view of a diamond screen.

A diamond roll screen is illustrated generally in FIG. 3, with the diamond screen including a plurality of rolls 30 having diamond edges or toothed edges 31 rather than disks (as in the case of a disk screen). Diamond roll screens are used for separating unders, and thus may be utilized in lieu of the gyratory screen 16. It is also possible to use a diamond screen as a flow management screen.

Figure 4:
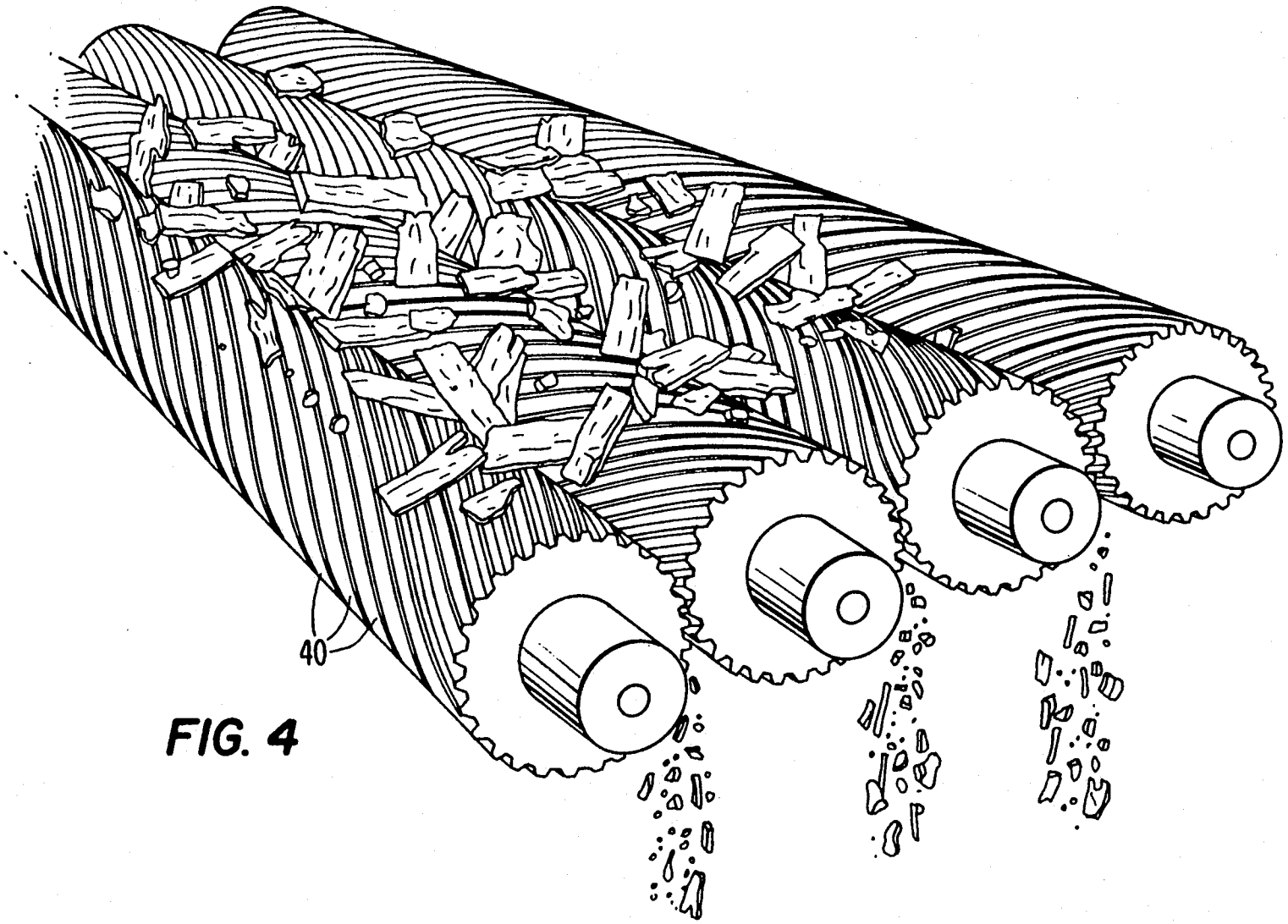
FIG. 4 illustrates a partial perspective view of a spiral roll screen.

A spiral roll is shown in FIG. 4 and includes spiral or helical grooves 40 extending along the length of each roll. Spiral roll screens are effective in separating overs, and may be utilized as either a flow management screen (12) or a primary thickness screen (14).

As with the disk screen, the diamond and spiral rolls allow a portion of the flow to pass between adjacent rolls, while another fraction of the flow, generally including the larger chips, flows over the rolls and out of the screen. The I.F.O. for spiral and diamond rolls is measured as the gap distance between outermost peripheries of adjacent rolls, for example as shown at 32 of FIG. 3.

A significant aspect of the present invention resides in the flow management screen or burden screen producing two flows, neither of which is acceptable for feeding to the digester, however both of which may be more readily fractioned to provide acceptable flows to the digester by second and third screening stations. The following examples will further illustrate the present invention, however are not to be construed as limiting the invention to particular flow rates or sizes of the various system components. It is to be understood that other flow rates and screen sizings may be utilized to optimize a given system in accordance with various factors, for example to accommodate varying requirements as to what constitutes an acceptable flow to the digester (which as discussed earlier may vary according to varying standards among different pulping mills) or to accommodate differing incoming flows, for example flows having differing proportions of chip sizes forming the incoming flow ($F_1$ of FIG. 1).

A significant advantage of the present invention resides in the reduction of maintenance and replacement costs. As screens wear, the I.F.O.'s may become both larger and smaller as disks bend and abrade, and disk shafts shift. For example, a new disk screen having a nominal I.F.O. of 7.0 mm will have an I.F.O. standard deviation of approximately 0.40 mm. As the screen wears the standard deviation will generally increase. With the flow management screen operating under high loads (1.2–1.8 B.D.T./hr./ft.$^2$), even with an I.F.O. standard deviation of 1.2 mm (which might approximate 3–4 years of wear) tests have shown overthick removal efficiencies as high as 96–98%, since the overthicks do not have the opportunity to access the flaws resulting from wear. The flow management screen can thus operate satisfactorily with 3–4 times the normal new I.F.O. standard deviation, which would be totally unacceptable in a primary disk screen of systems presently in use. The flow management screen can thus withstand the burdens of high loads, pins and fines abrading, while removing 96–98% of the overthick together with accepts in flow $F_3$, and decreasing the load and abrading pins and fines to the V-screen by directing accepts and unders to the gyratory screen ($F_2$). Moreover, as mentioned earlier, using a horizontal screen as the flow management screen, even further benefits are realized in protecting the primary V-screen which is more costly to maintain.

It has been found that by controlling what will be referred to as the "Loading Aspect Ratio" and the "I.F.O. Aspect Ratio" of the flow management screen 12 with respect to the primary or main thickness screen 14, the process can be optimized to perform on highly selective flow proportioning bases. The Loading Aspect Ratio is defined as the load at $F_1$ divided by the load at $F_3$ in terms of B.D.T./hr./ft.$^2$ (bone dry tons per hour per square foot of the respective screen areas). Loading aspect ratios of between 2.0 and 16.0 may be utilized, with the best results generally occurring with a loading ratio of between 3.0 and 8.0, for typically composed incoming flows $F_1$. In practice, the higher the Loading Aspect Ratio, the smaller the flow management screen or burden screen with respect to the main or primary thickness screen 14.

The I.F.O. Aspect Ratio is the I.F.O.1 divided by the I.F.O.2, with I.F.O.1 equal to the interface opening (for disk screens) or thickness gap (for spiral or diamond rolls) of the flow management screen 12 and I.F.O.2 equal to the interface opening or the thickness gap of the primary screening or main screening unit 14. I.F.O. aspect ratios of between 0.71 and 2.3 would be considered within normal operating ranges, with the best results occurring with I.F.O. ratios between 1.15 and 1.31.

In a typical pulping process, chips greater than 6–8 mm are generally overs, while unders would be chips smaller than this range. In typical systems currently in use, an I.F.O. of 7.0 mm for the primary disk screen is utilized for separating the overs. In accordance with the present invention, the flow management screen may have an I.F.O. of 5.0–12.0 mm, with I.F.O.s closer to 7.5–9.5 mm more likely. The primary or main thickness screen may be retained at approximately 7.0 mm, however, since the load to the main thickness screen is reduced, the I.F.O. may be tightened, for example to 6.0–6.5 mm, resulting in a significantly higher effectiveness (15–25%) in separating overs from accepts.

In addition to the loading and I.F.O. ratios, control of the rotational speeds of the disks of the screens can also be optimized for additional benefits. Basically this would involve the selection of an operational speed for rotation of the disks that is best suited for the particular installation to vary the proportion of the flow which passes over the screen (i.e., into flow $F_3$). In optimizing the various operating characteristics, the flow $F_3$ can be varied to comprise as little as 20% to as much as 80% of the incoming chip flow. As would be recognized by one skilled in the art the proportions which flow over and through the screen depend upon the flow rate and I.F.O. as well as the disk rotational speed. With this additional (i.e., rotational speed in addition to I.F.O. and flow rate) optimization, it has been found that the burden screen or flow management screen can be designed to operate with high proficiency in removing overthick chips on the order of 96% to 98% on a sustained basis, as well removing a substantial portion of the pins and fines from the flow (for example, for passage to the gyratory screen) prior to the flow reaching the primary thickness screen. An optimal disk rotational speed would be approximately 40 rpm, however speeds of 30–80 rpm are contemplated. Generally, it is contemplated that the burden screen or flow management screen will divide the incoming flow into two flows $F_2$, $F_3$ having somewhat equal mass flow rates. It is certainly conceivable, however, that one of the flows may be as much as 70–80% of the incoming flow with the other output from the burden screen of flow management screen 12 forming the remainder of the incoming flow.

Table I illustrates sample test data obtained utilizing a system as shown in FIG. 1. As indicated in the last line of Table I, the output flows from the flow management screen include approximately 46% going to the gyratory screen and 54% passing to the V-disk screen. An I.F.O. of 7.0 mm was utilized, with a loading rate of the flow management screen of 1.3 B.D.T./hr./ft.$^2$ which corresponds to a loading rate of 1.2 units per hour/ft.$^2$. (A unit in the industry is standardly recognized as 200 cubic feet of uncompressed wood chips).

TABLE I

| | Incoming Feed ($F_1$) | Disk Through Going To Gyratory ($F_2$) | Disk Overs Going To "V" Screens ($F_3$) |
|---|---|---|---|
| % 10 mm Thick | 7.06 | 0.00 | 12.95 |
| % 8 mm Thick | 5.39 | 0.30 | 9.66 |
| % 7 mm Accepts | 79.12 | 82.71 | 75.28 |
| % 5 mm Lg. Pins | 5.07 | 10.00 | 1.43 |
| % 3 mm Sm. Pins | 1.64 | 3.63 | 0.24 |
| % Pan Fines | 1.72 | 3.36 | 0.44 |
| % Mass Splits | 100 | 46 | 54 |

Figure 5:
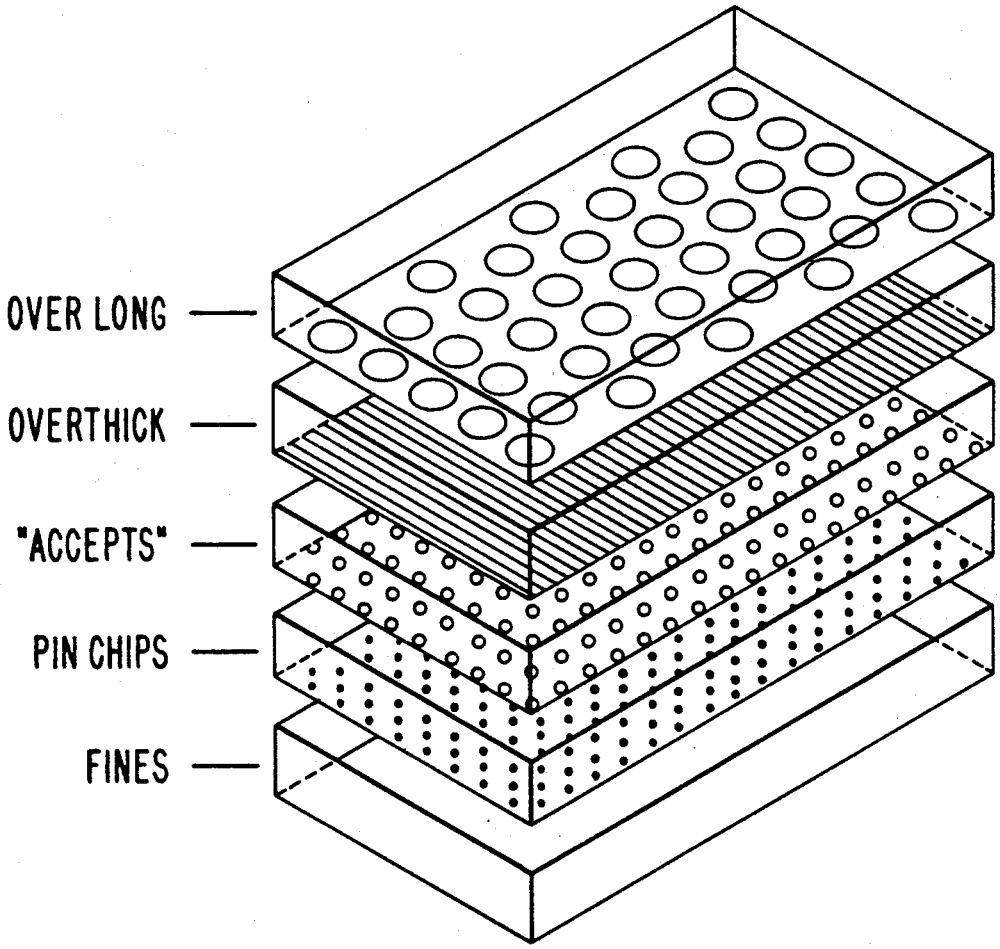
FIG. 5 illustrates laboratory screens utilized for classifying wood chips and particles to determine the composition of a sample of chips.

For better understanding, brief reference is made to FIG. 5 which illustrates various screens typically utilized for sizing flow samples. The screen designated "Over Long" retains large wood portions and would retain chips 45 mm or greater. The "Overthick" screen includes a plurality of slots for retaining chips above a certain thickness. In obtaining the Table I data, two "Overthick" screens were utilized, one for retaining chips over 10 mm, the other for retaining chips which were over 8 mm but which would not be retained in the 10 mm screen. The "Accepts" screen retains chips which pass through the larger screen, and which are larger than a selected lower size limit of the accepts aperture (7 mm in the Table 1 data). As with the "Overthick", two "Pin Chip" screens were utilized in obtaining the Table I data to break down the flow samples into larger and smaller pin chips. The "Fines" includes very small particles, such as sawdust, which are not retained by the other screens.

As shown in Table I, the flow management screen provides a flow $F_3$ to the primary thickness screen (14, FIG. 1) which is concentrated in overs compared to the inflow $F_1$ and which contains very little unders, pins or fines. The flow $F_2$ going to the gyratory screen contains very little overs, and is concentrated in unders compared to the incoming flow. Thus, the flow management screen provides a flow to the primary thickness screen which is acceptable from an unders standpoint, but unacceptable from an overs standpoint, and the primary thickness screen, which is particularly suitable for separation of overs, separates the overs and provides an acceptable flow to the digester. Conversely, the flow to the gyratory screen $F_2$ is acceptable from an overs standpoint, but unacceptable from an unders standpoint and the gyratory screen separates the unders and provides an acceptable flow $F_4$ to the digester.

As mentioned above, 1.3 B.D.T./hr./ft.$^2$ incoming flow rate was utilized in the Table I data. This represents an increase, by a factor of 4–5, over incoming flow rates to primary screens of existing systems (which are typically 0.30 B.D.T./hr./ft.$^2$). Since the flow management screen divides the flow, the flow to the primary screen is actually reduced (allowing more effective separation). Thus, the present invention allows an increase in the overall system feed, while feed to the main thickness screen is actually reduced, providing increased sizing effectiveness and decreased wear.

While a detailed description has been provided of preferred forms of the present invention to enable one skilled in the art to make and use the invention, it is to be understood that other forms and modifications are contemplated within the scope of the present invention. For example, while the flows from the second and third screening stations to the digester have been referred to as acceptable, it is possible that these flows only come within the desired acceptable ranges when combined. As an illustration, a pulping mill might designate that unders comprise 1.5% or less of the flow to the digester. If the flow $F_4$ includes say 2.0% unders, this could be acceptable, since when the flow $F_4$ is combined with flow $F_7$, the proportion of unders in the total flow is within the prescribed limit. Thus, while it is generally expected that the flows $F_7$ and $F_4$ are each "acceptable," the term acceptable should be construed in accordance with the present invention to mean "acceptable for feed to the digester without further screening", as the proportions of unders and overs may come within the prescribed limits only as the flows $F_7$ and $F_4$ are combined.

I claim:

1. A process for fractionating and sizing a flow of chips such as wood chips to provide an acceptable flow of wood chips in which wood chips within a predetermined range of sizes are sufficiently proportioned as to provide a flow which is acceptable for feeding to a pulp digester, wherein an incoming flow of wood chips is unacceptable due to high levels of wood chips which are larger or over the predetermined size range and high levels of wood chips or wood particles which are smaller or under the predetermined size range, the process comprising:

feeding a first incoming flow to a flow management screen station at which the flow is fractioned into second and third flows, neither of which constitutes an acceptable flow, wherein the second flow contains a majority of the undersized chips and a portion of chips within the predetermined size range, and a third flow contains a majority of the oversized chips and another portion of chips within the predetermined range;

feeding the second flow to a second screening station and separating the second flow into fourth and fifth flows, with the fourth flow acceptable for feeding to a pulp digester and the fifth flow comprising a substantial majority of the chips which are smaller than the predetermined size range; and feeding the third flow to a third screening station and separating the second flow into sixth and seventh flows, with the seventh flow acceptable for feeding to a pulp digester, and the sixth flow containing a majority of the chips which are larger than the predetermined size range.

2. The process of claim 1, wherein the step of feeding the first incoming flow to a flow management screen includes feeding the incoming flow to a disk screen.

3. The process of claim 1, wherein the step of feeding the second flow to a second screening station includes feeding the second flow to a gyratory screen.

4. The process of claim 1, wherein the step of feeding the third flow to a third screening station includes feeding the second flow to a disk screen.

5. The process of claim 4, wherein the step of feeding the third flow to a disk screen includes feeding the third flow to a V-disk screen.

6. The process of claim 2, wherein the step of feeding the third flow to a third screening station includes feeding the third flow to a second disk screen.

7. The process of claim 2, wherein the disk screen of the flow management screen station has an interface opening in the range of 5.0–12.0 mm.

8. The process of claim 6, wherein the step of feeding the second flow to a second screening station includes feeding the second flow to a gyratory screen.

9. The process of claim 8, wherein the second disk screen is a V-disk screen.

10. The process of claim 6, further including providing the first mentioned disk screen and the second disk screen with interface openings, such that the ratio of the interface opening of the first mentioned disk screen divided by the interface opening of the second disk screen is in the range of 0.71 to 2.3.

11. The process of claim 6, wherein the step of feeding the first incoming flow and feeding the third flow includes providing a loading ratio in the range of 2.0–16.0, wherein the loading ratio is defined as the loading of the first mentioned disk screen measured in mass per unit time per unit area of the first mentioned disk screen divided by the load on the second disk screen measured in mass per unit time per unit area of the second disk screen.

12. The process of claim 1, further including providing one of a disk screen, a diamond screen and a spiral roll screen at the flow management screen station, and providing one of a disk screen and a spiral roll screen at the third screening station; and providing the screens at the respective flow management and third screening stations with interface openings or thickness gap ratios in the range of 0.71 to 2.3, wherein the interface opening or thickness gap ratio is the interface opening or thickness gap of the screen of the flow management screen station divided by the interface opening or thickness gap of the screen of the third screening station.

13. The process of claim 10, wherein the steps of feeding the first incoming flow to a flow management screen station and feeding the third flow to a third screening station include providing respective flow rates such that a loading ratio comprising the loading of the flow management screen station divided by the loading of the third screening station is between 2.0 and 16.0, with the loading defined in terms of mass per unit time per unit area of the respective screens.

14. The process of claim 1, wherein the first step of feeding the incoming flow to a flow management screen includes feeding the flow to a spiral roll screen.

15. The process of claim 1, wherein the first step of feeding the flow to a flow management screen includes feeding the incoming flow to a diamond screen.

16. The process of claim 1, further including dividing the third flow into a eighth flow at the third screening station.

17. The process of claim 16, further including feeding the eighth flow to the second screening station.

18. The process of claim 1, wherein the step of feeding the second flow to a second screening station includes feeding the first flow to a diamond screen.

19. The process of claim 1, wherein the step of feeding the first incoming flow to a flow management screen includes feeding the incoming flow to a screen having a plurality of interface openings for screening chips to control thickness.

20. A process for fractionating and sizing chips such as wood chips to provide a flow of chips which is acceptable for feeding to a digester of a pulping system, wherein an acceptable flow contains below a prescribed limit of chips or particles which are smaller than a predetermined size range or "unders", and an acceptable flow also contains below a prescribed limit of chips which are larger than the predetermined size range or "overs", wherein an incoming flow is unacceptable due to proportions of overs and unders which are above the respective prescribed limits, the process comprising:

feeding a first incoming flow to a flow management screen station and dividing the flow into second and third fractional flows such that the second fractional flow contains an acceptable proportion of overs but an unacceptable proportion of unders, and the third fractional flow contains an acceptable proportion of unders but an unacceptable proportion of overs;

feeding the second fractional flow to a second screening station and dividing the second fractional flow into fourth and fifth flows, such that the fourth flow is acceptable for feeding to a pulp digester, and the fifth flow is concentrated in unders compared to the second fractional flow; and feeding the third fractional flow to a third screening station and dividing the third fractional flow into sixth and seventh flows, such that the seventh flow is acceptable for feeding to the digester and the sixth flow is concentrated in overs compared to the third fractional flow.

21. A wood chip fractionating and sizing system for providing a flow of wood chips which is acceptable for feeding to a digester of a pulping system, wherein an acceptable flow contains below a prescribed proportion of chips or particles which are smaller than a predetermined size range or "unders", and an acceptable flow also contains below a prescribed proportion of chips which are larger than the predetermined size range or "overs", wherein an incoming flow is unacceptable due to proportions of overs and unders which are above the respective prescribed limits, the system comprising:

a flow management screen station for dividing a first incoming flow into second and third fractional flows such that the second fractional flow is concentrated in unders compared to the first incoming flow and the third flow is concentrated in overs compared to the first incoming flow;

a second screening station for receiving the second fractional flow and for dividing the second fractional flow into fourth and fifth flows such that the fourth flow is acceptable for feeding to a pulp digester and the fifth flow is concentrated in unders compared to the second flow; and a third screening station for receiving the third fractional flow and for dividing the third fractional flow into sixth and seventh flows such that the seventh flow is acceptable for feeding to the digester and the sixth flow is concentrated in overs compared to the second fractional flow.

22. The system of claim 21, wherein the flow management screen station comprises a disk screen.

23. The system of claim 21, wherein the third screening station comprises a disk screen.

24. The system of claim 22, wherein the third screening station comprises a disk screen.

25. The system of claim 24, wherein the second screening station comprises a gyratory screen.

26. The system of claim 24, wherein an interface opening ratio of the interface opening of the flow management disk screen divided by the interface opening of the third screening station disk screen is within the range of 0.71 to 2.3.

27. The system of claim 21, wherein the flow management screen station comprises a diamond screen.

28. The system of claim 21, wherein the second screening station comprises a gyratory screen.

29. The system of claim 22, wherein the second screening station comprises a gyratory screen.

30. The system of claim 21, wherein the flow management screen station comprises a spiral roll screen.

31. The system of claim 21, wherein the third screening station comprises a spiral roll screen.

32. The system of claim 21, wherein said third screening station comprises means for directing an eighth flow to said second screening station.

33. The system of claim 24, further including flow control means for controlling loading of the system such that a loading ratio of the loading of the flow management screen station divided by the loading of the third screening station is within the range of 2.0 to 16.0, wherein the loading for each screen is measured in terms of mass per unit time per unit area of each respective screen.

34. The system of claim 26, further including flow control means for controlling loading of the system such that a loading ratio of the loading of the flow management screen station divided by the loading of the third screening station is within the range of 2.0 to 16.0, wherein the loading for each screen is measured in terms of mass per unit time per unit area of each respective screen.

35. A process for fractionating and sizing a flow of chips such as wood chips in which a first incoming flow of wood chips is unacceptable for feeding to a pulp digester, and wherein an acceptable flow is desired in which at least a predetermined proportion of chips are within a predetermined size range, the process comprising:

providing a first screening station having a rotating shaft type screen;

providing a first incoming flow to the first screening station such that the first screening station divides the first incoming flow into second and third flows;

said second flow comprising chips which pass through the rotating shaft type screen;

said third flow comprising chips which pass over the rotating shaft type screen;

wherein the step of providing a first incoming flow includes providing an incoming flow at a sufficiently high rate such that the third flow includes a substantial portion of chips within the predetermined size range as well as chips larger than the predetermined size range;

the process further comprising feeding the third flow to a screening station comprising a second rotating shaft type screen and dividing the third flow into an acceptable flow of chips passing through the second rotating shaft type screen and an overs flow which passes over the rotating shaft type screen and which contains a majority of the chips from said incoming flow which are over the predetermined size range.

36. The process of claim 35, wherein the step of providing a first screening station having a rotating shaft type screen includes providing a disk screen.

37. The process of claim 36, wherein the disk screen is a horizontal disk screen.

38. The process of claim 37, wherein the step of providing a second rotating shaft type screen includes providing a disk screen.

39. A chip screening apparatus for sizing and fractionating wood chips in which an incoming flow of wood chips is unacceptable for feeding to a pulp digester due to an unacceptable proportion of chips being outside a predetermined size range, the apparatus including:

a first screening station for receiving a first incoming flow and dividing the flow into second and third flows, said screening station including a disk screen, wherein the second flow is the flow of chips passing through the disk screen, and the third flow is the flow of chips which pass over the disk screen, wherein the disk screen separates the incoming flow such tat the third flow includes a majority of the oversized chips and a substantial portion of chips within the predetermined size range; and a screening station for receiving the third flow including a rotating shaft type screen, wherein the screen rotating shaft type receives the third flow and divides the third flow into an acceptable flow and an overs flow, wherein the overs flow includes a majority of the chips from the first incoming flow which are over the predetermined size range, said overs flow including chips which pass over the rotating shaft type screen, said acceptable flow including a flow of wood chips which is acceptable for feeding to the pulping digester, said acceptable flow including chips which pass through the rotating shaft type screen.

40. The apparatus of claim 39, wherein the rotating shaft type screen receiving the third flow comprises a disk screen.

41. The apparatus of claim 40, wherein the disk screen of the first screening station is a horizontal disk screen, and the disk screen receiving the third flow is a V-disk screen.

42. The apparatus of claim 39, further including a gyratory screen station for receiving said second flow.

* * * * *